US009620883B2

(12) United States Patent
Oomori et al.

(10) Patent No.: US 9,620,883 B2
(45) Date of Patent: Apr. 11, 2017

(54) CONNECTOR WITH WIRE HAVING INSULATION COATING REMOVED FROM AN END PART AND A THIN COATING LAYER OF PHOTOCURABLE RESIN APPLIED TO THE END PART

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Yasuo Oomori, Mie (JP); Hosei Mizuno, Mie (JP); Hiroki Hirai, Mie (JP); Masaaki Tabata, Mie (JP); Manabu Uesato, Mie (JP)

(73) Assignees: AUTONETWORKS TECHNOLOGIES, LTD., Yokkaichi-Mie (JP); SUMITOMO WIRING SYSTEMS, LTD., Yokkaichi-Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/911,291

(22) PCT Filed: Aug. 12, 2014

(86) PCT No.: PCT/JP2014/071272

§ 371 (c)(1),
(2) Date: Feb. 10, 2016

(87) PCT Pub. No.: WO2015/029770

PCT Pub. Date: Mar. 5, 2015

(65) Prior Publication Data

US 2016/0190723 A1 Jun. 30, 2016

(30) Foreign Application Priority Data

Sep. 2, 2013 (JP) ..... 2013-181322

(51) Int. Cl.
*H01R 13/02* (2006.01)
*H01R 13/424* (2006.01)
(Continued)

(52) U.S. Cl.
CPC ..... *H01R 13/424* (2013.01); *H01R 13/03* (2013.01); *H01R 24/28* (2013.01); *H01R 43/28* (2013.01); *H01R 4/185* (2013.01); *H01R 13/4361* (2013.01)

(58) Field of Classification Search
CPC . H01R 4/20; H01R 4/58; H01R 4/185; H01R 4/188; H01R 13/03; H01R 9/24; H01R 13/02
(Continued)

(56) References Cited

U.S. PATENT DOCUMENTS 6,075,065 A * 6/2000 Yamazaki ..... C03C 25/106 522/28
6,583,198 B2 * 6/2003 Sato ..... C08G 59/1461 430/286.1
(Continued)

FOREIGN PATENT DOCUMENTS

EP 2533365 * 12/2012 ..... H01R 13/03
JP 2012-1740 1/2012
(Continued)

OTHER PUBLICATIONS

International Search Report.

*Primary Examiner* — Chandrika Prasad
(74) *Attorney, Agent, or Firm* — Gerald E. Hespos; Michael J. Porco; Matthew T. Hespos

(57) ABSTRACT

A conduction path (20) is formed by connecting a coated wire (26), in which a conductor (27) is surrounded by an insulation coating (28), to a rear end part of a terminal fitting (21) and the entire terminal fitting (21) and a front end part of the coated wire (26) are to be accommodated into a housing (10). The conduction path (20) includes a coating layer (29) made of a photocurable resin, provided in an area of the coated wire (26) to be accommodated into the housing (10), thinner than the insulation coating (28) and surrounding an area of the conductor (27) where the insulation coating (28) is removed.

7 Claims, 2 Drawing Sheets

(51) Int. Cl.

| | |
|---|---|
| ***H01R 13/03*** | (2006.01) |
| ***H01R 43/28*** | (2006.01) |
| ***H01R 24/28*** | (2011.01) |
| *H01R 4/18* | (2006.01) |
| *H01R 13/436* | (2006.01) |

(58) Field of Classification Search
USPC ..... 439/877, 886, 887
See application file for complete search history.

(56) References Cited

U.S. PATENT DOCUMENTS

| | | | | |
|---|---|---|---|---|
| 6,918,800 | B2 * | 7/2005 | Ota | H01R 13/03 439/181 |
| 9,318,815 | B2 * | 4/2016 | Mitose | H01R 4/183 |
| 2006/0121184 | A1 * | 6/2006 | Minamio | H01L 27/14618 427/162 |
| 2013/0056266 | A1 | 3/2013 | Inoue et al. | |
| 2013/0072074 | A1 * | 3/2013 | Inoue | H01R 4/70 439/886 |
| 2013/0133946 | A1 | 5/2013 | Morikawa et al. | |
| 2015/0357723 | A1 * | 12/2015 | Tachibana | C25D 7/00 439/878 |
| 2015/0357725 | A1 * | 12/2015 | Matsuo | C22C 9/00 439/877 |

FOREIGN PATENT DOCUMENTS

| | | |
|---|---|---|
| JP | 2012-43584 | 3/2012 |
| JP | 2013-16430 | 1/2013 |
| JP | 2013-125739 | 6/2013 |

* cited by examiner

CONNECTOR WITH WIRE HAVING INSULATION COATING REMOVED FROM AN END PART AND A THIN COATING LAYER OF PHOTOCURABLE RESIN APPLIED TO THE END PART

BACKGROUND

1. Field of the Invention

The present invention relates to a conduction path and a connector.

2. Description of the Related Art

Japanese Unexamined Patent Publication No. 2013-016430 discloses a conduction path formed by connecting a front end part of a coated wire to a rear end part of a terminal fitting. A front end part of this conduction path is inserted into a housing. In an inserted state, the entire terminal fitting and the front end part of the coated wire are accommodated in a terminal accommodating chamber of the housing and an area of the coated wire excluding the front end part is led out backward from the housing.

The coated wire described in Japanese Unexamined Patent Publication No. 2013-016430 is such that a conductor made of aluminum is surrounded by an insulation coating made of synthetic resin. Aluminum has a lower electrical resistivity than copper. Thus, to ensure that a conductor has a current value equivalent to that of a coated wire whose conductor is made of copper in a coated wire whose conductor is made of aluminum, an outer diameter (cross-sectional area) of the conductor needs to be larger than that of the conductor made of copper.

If the outer diameter of the conductor is made larger, an outer diameter of the coated wire also becomes larger. Thus, in the case of miniaturizing a terminal fitting, an outer diameter of a coated wire becomes relatively larger than a height and a width of the terminal fitting. In this case, if a cross-sectional area of terminal accommodating chambers is increased by expanding an arrangement interval of the terminal accommodating chambers, the coated wire can be accommodated into the terminal accommodating chamber. However, if the arrangement interval of the terminal accommodating chambers is expanded, the housing is enlarged.

The present invention was completed based on the above situation and aims to enable a front end part of a coated wire to be accommodated into a housing together with a terminal fitting without enlarging the housing even if an outer diameter of a conductor of the coated wire is large in a conduction path formed by connecting the front end part of the coated wire to a rear end part of the terminal fitting.

SUMMARY

A first aspect of this disclosure relates to a conduction path that is formed by connecting a coated wire, in which a conductor is surrounded by an insulation coating, to a rear end part of a terminal fitting. The conduction path is configured such that the entire terminal fitting and a front end part of the coated wire are to be accommodated into a housing, and includes a coating layer made of a photocurable resin. The coating layer made of a photocurable resin is provided in an area of the coated wire to be accommodated into the housing, is thinner than the insulation coating and surrounds an area of the conductor where the insulation coating is removed.

A second aspect of this disclosure relates to a connector with a housing and a conduction path formed by connecting a coated wire, in which a conductor is surrounded by an insulation coating, to a rear end part of a terminal fitting. The conduction path is configured such that the entire terminal fitting and a front end part of the coated wire are to be accommodated into the housing. The conduction path includes a coating layer that is made of a photocurable resin, is provided in an area of the coated wire to be accommodated into the housing, is thinner than the insulation coating and surrounds an area of the conductor where the insulation coating is removed.

Since the conductor is surrounded by the coating layer thinner than the insulation coating in the area of the coated wire to be accommodated into the housing, the front end part of the coated wire can be accommodated into the housing without enlarging the housing even if an outer diameter of the conductor is large.

The coating layer may have a higher rigidity than the insulation coating. Accordingly, a reduction of the buckling strength of the coated wire can be avoided even if the coating layer is thin.

The coating layer may be made of an ultraviolet curable resin. Accordingly, the photocurable resin can be cured in a short time by ultraviolet light having a higher density of light energy than visible light.

The coating layer may be fixed to an outer periphery of the conductor by molding. The molded coating layer is satisfactorily in close contact with the conduction path.

DETAILED DESCRIPTION

Figure 1:
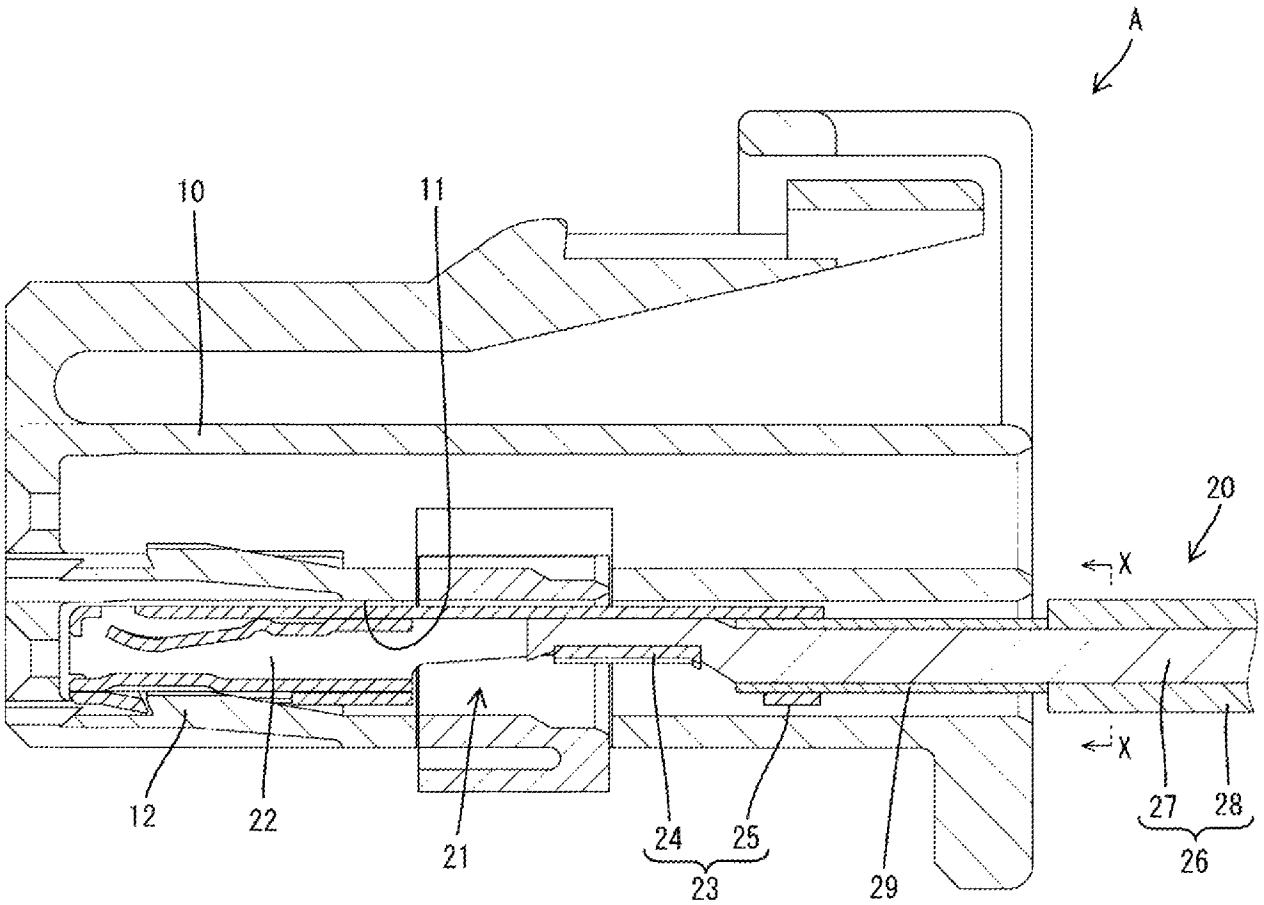
FIG. 1 is a section of a connector of one embodiment.

Hereinafter, a specific embodiment of the present invention is described with reference to FIGS. 1 and 2. A connector A of this embodiment includes a housing 10 and a plurality of conduction paths 20.

Housing 10

A plurality of terminal accommodating chambers 11 penetrating in a front-back direction are formed in the housing 10. A front end part of the conduction path 20 (i.e. entire terminal fitting 21 and a front end part of a coated wire 26) is inserted into each terminal accommodating chamber 11 from behind the housing 10. A resiliently deflectable locking lance 12 for retaining the inserted terminal fitting 21 is formed at an inner wall of the terminal accommodating chamber 11. As shown in FIG. 2, a cross-sectional shape of the terminal accommodating chamber 11 (cross-sectional shape perpendicular to an inserting direction of the conduction path 20 into the terminal accommodating chamber 11) is a vertically long rectangular shape whose longer sides extend in a vertical direction.

Conduction Path 20

One conduction path 20 includes the terminal fitting 21, the coated wire 26 connected to a rear end part of the terminal fitting 21 and a coating layer 29 formed on the coated wire 26. The terminal fitting 21 is formed into a shape long and narrow in the front-back direction as a whole by applying bending and the like to a plate material made of copper. A rectangular tube portion 22 is formed on a front end side of the terminal fitting 21 and a crimping portion 23 in the form of an open barrel is formed on a rear end side of the terminal fitting 21. The crimping portion 23 is composed of a wire barrel 24 arranged on a front side and an insulation barrel 25 arranged on a rear side. The insulation barrel 25 is located on the rear end part of the terminal fitting 21. The front end part of the coated wire 26 is fixed electrically conductively to this crimping portion 23.

The coated wire 26 is of a known form and is configured so that the outer periphery of a conductor 27 is surrounded over the entire circumference by an insulation coating 28. The conductor 27 is a twisted wire of a known form obtained by twisting a plurality of strands (not shown) made of aluminum. A cross-sectional shape of the conductor 27 perpendicular to an axis line is a substantially circular shape. The insulation coating 28 is made of a flexible synthetic resin material. A cross-sectional shape of the insulation coating 28 perpendicular to the axis line is a circular annular shape concentric with the conductor 27, and the inner periphery of the insulation coating 28 is held in close contact with the outer periphery of the conductor 27.

The conductor 27 is made of aluminum. Aluminum has a lower electrical resistivity than copper. Thus, to ensure that the conductor 27 has a current value equivalent to that of a coated wire whose conductor is made of copper in the coated wire 26 of this embodiment, an outer diameter (cross-sectional area) of the conductor 27 is made larger than that of the conductor made of copper. Thus, as shown in FIG. 2, an outer diameter Da of the coated wire 26 (outer diameter of the insulation coating 28) is larger than a width W of the terminal accommodating chamber 11. However, when the terminal fitting 21 is accommodated into the terminal accommodating chamber 11, the front end part of the coated wire 26 also needs to be accommodated into the terminal accommodating chamber 11.

Accordingly, a front end area of the coated wire 26 to be accommodated into the terminal accommodating chamber 11 is changed in shape so that the outer diameter becomes smaller than the width W of the terminal accommodating chamber 11. That configuration is described below. In the front end area of the coated wire 26 to be accommodated into the terminal accommodating chamber 11, the insulation coating 28 is stripped and removed from the conductor 27. Since a front end part of the area where the insulation coating 28 is removed from the conductor 27 corresponds to the wire barrel 24 of the crimping portion 23, the conductor 27 is left exposed. The coating layer 29 is formed on the outer periphery of the conductor 27 in an area corresponding to the insulation barrel 25 and a rear end area behind the insulation barrel 25 out of the area where the insulation coating 28 is removed from the conductor 27.

Figure 2:
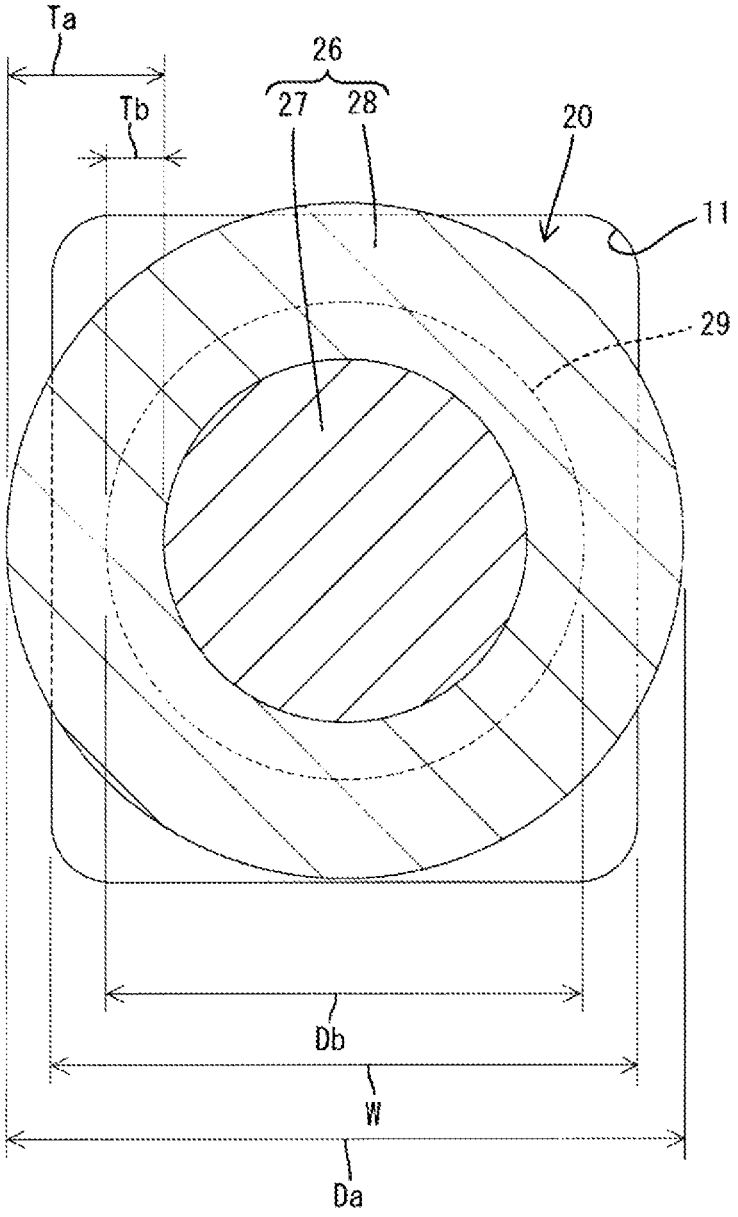
FIG. 2 is a section along X-X of FIG. 1.

As shown in FIG. 2, a cross-sectional shape of the coating layer 29 perpendicular to the axis line is a circular annular shape concentric with the conductor 27 similarly to the insulation coating 28. A radial thickness Tb of the coating layer 29 is smaller than a thickness Ta of the insulation coating 28. Since the inner periphery of the coating layer 29 is held in close contact with the outer periphery of the conductor 27, an outer diameter Db of the coating layer 29 is smaller than the outer diameter Da of the insulation coating 28. The outer diameter Db of this coating layer 29 is smaller than the width W of the terminal accommodating chamber 11. Accordingly, an area of the coated wire 26 where the coating layer 29 is formed can be accommodated into the terminal accommodating chamber 11. Further, the rear end of the coating layer 29 abuts on the front end of the insulation coating 28. Furthermore, the rigidity of the coating layer 29 is set to be higher than that of the insulation coating 28.

The front end part of the coated wire 26 is connected to the rear end part of the terminal fitting 21 by crimping the crimping portion 23. Specifically, the conductor 27 exposed before the coating layer 29 is fixed electrically conductively by caulking the wire barrel 24 to this exposed conductor 27. Further, a front end area of the area of the coated wire 26 where the conductor 27 is surrounded by the coating layer 29 is fixed by caulking the insulation barrel 25 to this area. Thus, the insulation barrel 25 is not crimped to the insulation coating 28. The terminal fitting 21 is crimped to the coated wire 26 using an applicator (automatic machine).

As described above, the conduction path 20 formed by connecting the coated wire 26 to the rear end part of the terminal fitting 21 is inserted into the terminal accommodating chamber 11 from behind the housing 10. With the insertion completed, the entire terminal fitting 21, the area of the coated wire 26 where the conductor 27 is exposed and the area of the coated wire 26 where the coating layer 29 is formed are accommodated in the terminal accommodating chamber 11. Then, by locking the locking lance 12 to the terminal fitting 21, the front end part of the conduction path 20 is retained and held. Note that the area of the coated wire 26 where the conductor 27 is surrounded by the insulation coating 28 is led out from the housing 10 (terminal accommodating chamber 11).

Photocurable Resin

The coating layer 29 is made of a photocurable resin. The photocurable resin is composed of monomers, oligomers, a photopolymerization initiator (photoinitiator) and various additives. When light is irradiated with the photocurable resin in a liquid state, the photocurable resin is cured by light energy. Such materials as to provide a predetermined rigidity according to buckling strength required for the coated wire 26 after curing are selected as the additives. Further, photocurable resins are roughly classified into ultraviolet curable resins and visible light curable resins. In this embodiment, an ultraviolet curable resin is used as the material of the coating layer 29.

The ultraviolet curable resin is used as the material of the coating layer 29 for the following reason. A crimping process of the coated wire 26 and the terminal fitting 21 is automated by the applicator. By using an automatic machine (not shown) in which a facility for photocuring is attached to this applicator, a photocuring process for forming the coating layer 29 in succession to the crimping process can be automated. Since the crimping process is performed in a short time, a time required for the photocuring process is desirably also shortened to perform both processes successively and automatically. The higher the density of received light energy, the shorter a curing time of the photocurable resin. Ultraviolet light has a higher density of light energy than visible light. Thus, the ultraviolet curable resin having a shorter curing time than visible light curable resins was used.

Manufacturing Process of Conduction Path 20 by Automatic Machine

A manufacturing process of the conduction path 20 by the automatic machine (not shown) is described. Manufacturing is carried out by successively performing a stripping process, the photocuring process and the crimping process. In the stripping process, the insulation coating 28 on the front end part of the coated wire 26 is removed to expose the front end part of the conductor 27. In the photocuring process, the coated wire 26 is first supplied to a mold (not shown) and set in a state positioned in a length direction. Subsequently, the liquid photocurable resin (ultraviolet curable resin) is poured into the mold and, thereafter, ultraviolet light is irradiated to the liquid photocurable resin in the mold. By the irradiation of the ultraviolet light, the photocurable resin is cured and the coating layer 29 is molded in a state fixed to the outer periphery of the conductor 27.

In the crimping process thereafter, the terminal fitting 21 is supplied to a predetermined crimping position and placed on an anvil. Subsequently, the exposed conductor 27 of the coated wire 26 is set in the wire barrel 24 and the front end part of the area of the coated wire 26 where the coating layer 29 is formed is set in the insulation barrel 25. Then, by lowering a crimper, the crimping portion 23 is caulked to surround the coated wire 26 and the coated wire 26 and the terminal fitting 21 are connected.

Functions and Effects of Embodiment

The connector A of this embodiment includes the housing 10 and the conduction path 20 formed by connecting the coated wire 26, in which the conductor 27 is surrounded by the insulation coating 28, to the rear end part of the terminal fitting 21, and the entire terminal fitting 21 and the front end part of the coated wire 26 are accommodated into the housing 10. The coating layer 29 made of the photocurable resin is provided in the area of the coated wire 26 to be accommodated into the housing 10. The coating layer 29 made of the photocurable resin is thinner than the insulation coating 28 and surrounds the area of the conductor 27 having the insulation coating 28 removed therefrom.

In the area of the coated wire 26 of this embodiment to be accommodated into the housing 10, the conductor 27 is surrounded by the coating layer 29 thinner than the insulation coating 28. Thus, even if the outer diameter of the conductor 27 is large, the front end part of the coated wire 26 can be accommodated into the housing 10. This eliminates the need to expand an arrangement interval of the terminal accommodating chambers 11 to increase the cross-sectional area of the terminal accommodating chambers 11, and hence the enlargement of the housing 20 is avoided.

Further, the coating layer 29 arranged between the rear end of the terminal fitting 21 and the front end of the insulation coating 28 is thinner than the insulation coating 28. Thus, when an operator inserts the terminal fitting 21 into the terminal accommodating chamber 11 by gripping the insulation coating 28, the coated wire 26 may be buckled and deformed in the formation area of the coating layer 29 due to insertion resistance acting on the terminal fitting 21 from the locking lance 12. However, the rigidity of the coating layer 29 is be higher than that of the insulation coating 28 in this embodiment. Therefore, the buckling strength of the coated wire 26 is not reduced even if the coating layer 29 is thinner than the insulation coating 28. Thus, the front end part of the conduction path 20 can be inserted into the terminal accommodating chamber 11 without causing the buckling of the coated wire 26.

The present invention is not limited to the above described and illustrated embodiment. For example, the following embodiments are also included in the technical scope of the present invention.

Although the crimping portion of the terminal fitting is crimped to the coating layer in the above embodiment, the crimping portion may not be crimped to the coating layer by limiting the formation area of the coating layer to an area behind the rear end of the crimping portion.

Although the rigidity of the coating layer is set to be higher than that of the insulation coating in the above embodiment, the rigidity of the coating layer may be equal to or lower than that of the insulation coating.

Although an example of application to a non-waterproof connector is described in the above embodiment, the present invention can be applied also to waterproof connectors using individual rubber plugs. In this case, the individual rubber plugs may be mounted on the outer peripheries of coating layers.

Although an example of application to a non-waterproof connector is described in the above embodiment, the present invention can be applied also to waterproof connectors using a one-piece rubber plug. In this case, the coating layers may be passed through sealing holes of the one-piece rubber plug.

Although the rear end of the coating layer is in contact with the front end of the insulation coating in the above embodiment, the rear end of the coating layer may not be in contact with the insulation coating.

Although the ultraviolet curable resin is the material of the coating layer in the above embodiment, the material of the coating layer may be a visible light curable resin.

Although the outer peripheral shape of the coating layer (cross-sectional shape of the outer periphery when the coating layer is cut along a plane perpendicular to the axis line of the wire) is a true circular shape concentric with the outer periphery of the wire in the above embodiment, the outer peripheral shape of the coating layer may be a non-circular shape in conformity with the cross-sectional shape of the terminal accommodating chamber.

Although the conductor of the coated wire is made of aluminum in the above embodiment, the material of the conductor may be a metal such as copper without being limited to aluminum.

LIST OF REFERENCE SIGNS

A . . . connector
10 . . . housing
20 . . . conduction path
21 . . . terminal fitting
26 . . . coated wire
27 . . . conductor
28 . . . insulation coating
29 . . . coating layer

The invention claimed is:

1. A conduction path to be accommodated into a housing, comprising:

a wire having opposite first and second ends, a conductor extending from the first end to the second end, an insulation coating surrounding the conductor from a first location spaced from the first end toward the second end, a coating layer made of a photocurable resin surrounding the conductor from the first location to a second location between the first location and the first end, the coating layer being thinner than the insulation coating; and a terminal fitting having a wire barrel surrounding at least part of the conductor between the coating layer and the first end, and an insulation barrel surrounding at least part of the coating layer at a position spaced from the insulation coating; wherein:

the portions of the terminal fitting surrounding the wire and the portion of the wire having the coating layer thereon are dimensioned to be accommodated in the housing.

2. The conduction path of claim 1, wherein the coating layer has a higher rigidity than the insulation coating.

3. The conduction path of claim 2, wherein the coating layer is made of an ultraviolet curable resin.

4. The conduction path according of claim 3, wherein the coating layer is fixed to an outer periphery of the conductor by molding.

5. A connector, comprising:

a wire having opposite first and second ends, a conductor extending from the first end to the second end, an insulation coating surrounding the conductor from a first location spaced from the first end toward the second end, a coating layer made of a photocurable resin surrounding the conductor from the first location to a second location between the first location and the first end, the coating layer being thinner than the insulation coating; and a terminal fitting having a wire barrel surrounding at least part of the conductor between the coating layer and the first end, and an insulation barrel surrounding at least part of the coating layer at a position spaced from the insulation coating; and a housing having a cavity formed therein, the wire barrel, the insulation barrel and at least part of the wire between the insulation barrel and the insulation coating being accommodated in the cavity of the housing.

6. The connector of claim 5, wherein the coating layer is made of an ultraviolet curable resin.

7. The connector of claim 5, wherein the coating layer is fixed to an outer periphery of the conductor by molding.

* * * * *